US008998021B2

(12) United States Patent
Saxena

(10) Patent No.: US 8,998,021 B2
(45) Date of Patent: Apr. 7, 2015

(54) DUAL LUMEN STORAGE AND WASTE CONTAINER

(71) Applicant: Jannat Saxena, Cypress, CA (US)

(72) Inventor: Jannat Saxena, Cypress, CA (US)

( * ) Notice: Subject to any disclaimer, the term of this patent is extended or adjusted under 35 U.S.C. 154(b) by 0 days.

(21) Appl. No.: 13/850,184

(22) Filed: Mar. 25, 2013

(65) Prior Publication Data

US 2014/0252004 A1 Sep. 11, 2014

Related U.S. Application Data

(60) Provisional application No. 61/772,990, filed on Mar. 5, 2013.

(51) Int. Cl.
*B65D 25/04* (2006.01)

(52) U.S. Cl.
CPC ..... *B65D 25/04* (2013.01)

(58) Field of Classification Search
CPC ..... B65F 1/006; B65F 1/04; B65F 1/02; B65F 1/08; B65F 1/004; B65D 23/12; B65D 25/04
USPC ..... 220/500, 503, 504, 507, 523, 527, 553; 221/97, 102, 123
See application file for complete search history.

(56) References Cited

U.S. PATENT DOCUMENTS

| | | | | |
|---|---|---|---|---|
| 4,955,503 | A * | 9/1990 | Propes | 220/526 |
| 5,934,501 | A * | 8/1999 | Wright et al. | 220/528 |
| 6,279,775 | B1 | 8/2001 | Parkes et al. | |
| 6,318,590 | B1 | 11/2001 | McMurray-Stivers | |
| 6,631,801 | B2 * | 10/2003 | Boyd-Moss et al. | 206/204 |
| 8,302,810 | B2 * | 11/2012 | Mulhem et al. | 221/34 |
| 2012/0199548 | A1 * | 8/2012 | Kitto | 215/316 |
| 2012/0285969 | A1 | 11/2012 | Kelly | |

* cited by examiner

*Primary Examiner* — Steven A. Reynolds
*Assistant Examiner* — Javier A Pagan
(74) *Attorney, Agent, or Firm* — Michael Fedrick; Loza & Loza, LLP

(57) ABSTRACT

A portable container having two interior lumens, a top cover, and a bottom cover, One of the lumens includes a lower disposal opening for easy disposal of waste items.

14 Claims, 10 Drawing Sheets

DUAL LUMEN STORAGE AND WASTE CONTAINER

BACKGROUND

Storing and disposing of personal use items while on the go is a long-standing problem. Items such as food or sanitary products must often be portably stored and then disposed of shortly after use, when there may or may not be a conveniently located waste disposal container. Portable storage containers which have been proposed include facial tissue dispensers, such as that disclosed in U.S. Pat. No. 8,302,810, and snack containers such as that of US Patent Publication No. 2012/0285969. However, such containers present difficulties in use, in particular with regard to the disposal of waste.

FIGURES

SUMMARY

Figure 1:
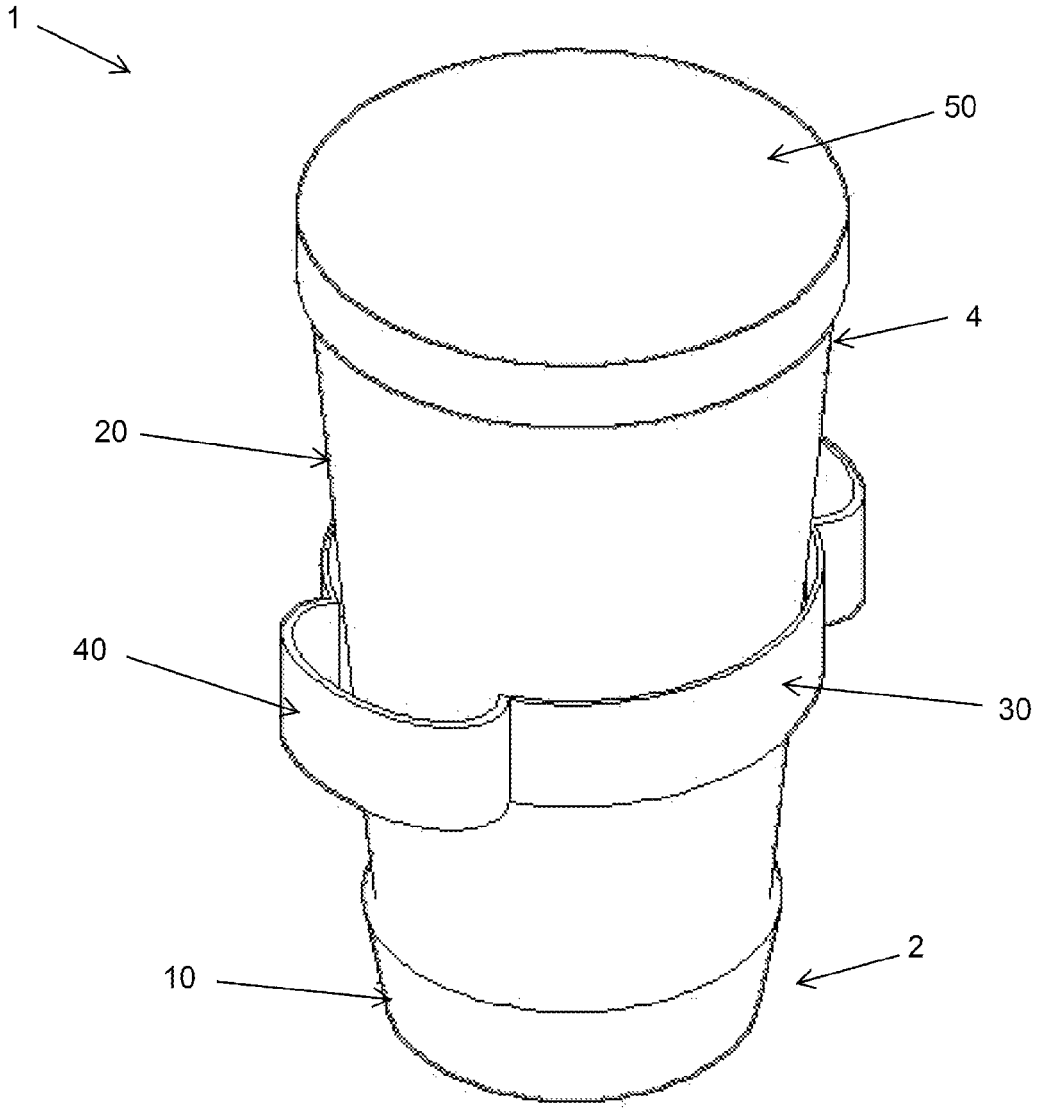
FIG. 1 is a perspective view of an embodiment of the present container.

There remains a need for a portable storage and waste container in which it is easier to store unused items while easily removing used items, for example while in a car, at a hike, on a bike, or pushing a stroller. The present solution includes a dual-lumen receptacle having a top portion and a bottom portion. One of the lumens has an open top and a closed bottom, in the manner of a convention cup, but the second lumen comprises an open top and open bottom. The open bottom of the second lumen is covered by a reversibly secured lower cover. Unused items are stored in the first lumen while used items are placed in the second lumen, having an open bottom. To empty used items from the second lumen without dispensing unused items from the first lumen, the lower cover is simply removed from the container, and a top cover is preferably placed on the container. A circumferential elastic band for securing items to the exterior of the container is also preferably included.

The present dual lumen portable storage and waste container includes a receptacle portion, and upper cover, and a lower cover. The receptacle has an open upper end, a lower end, and one or more vertical walls extending between the upper end and the lower end, as well as including two lumens. A first, open lumen has an open upper end, an open lower end, and one or more outer vertical walls extending between the upper end and the lower end, while a second, closed lumen has an open upper end, a closed lower end, and one or more outer vertical walls extending between the upper end and the lower end. A central vertical wall separates the first lumen from the second lumen, and a floor in the lower end of the second lumen extends between the central vertical wall and the one or more outer vertical walls of the second lumen, such that the floor, the central vertical wall, and the one or more outer vertical walls of the second lumen form a compartment having an open upper end and a closed lower end for storing unused items.

The container further includes an upper cover having a surface covering the open upper end of the receptacle portion and one or more downwardly extending vertical walls, and a lower cover having a horizontal surface covering the lower end of the receptacle portion and one or more upwardly extending vertical walls. The upper cover is reversibly securable to the upper end of the receptacle portion so as to cover the upper end of the receptacle portion, and the lower cover is reversibly securable to the lower end of the receptacle portion so as to cover the lower end of the receptacle portion.

The lower cover is preferably formed from an elastic material and is retained on the lower end of the receptacle portion by an interference fit, and the upper cover is likewise preferably formed from an elastic material and is retained on the lower end of the receptacle portion by an interference fit. The downwardly extending vertical walls of the upper cover can surround the periphery of the upper end of the receptacle portion and form a rim, and the upwardly extending vertical walls of the lower cover can likewise surround the periphery of the lower end of the receptacle portion and form a rim.

In one embodiment, the volume of the second (closed) lumen is greater than the volume of the first lumen. In this embodiment, the open upper end of the second lumen is larger in area than the open upper end of the first lumen. Alternatively, the open upper end of the first lumen can be larger in area than the open upper end of the second lumen. In one embodiment, the diameter of the upper end of the receptacle portion is greater than the diameter of the lower end of the receptacle portion, and the receptacle portion is frusto-conical in shape. The central vertical wall can extend from the upper end of the receptacle portion to the lower end of the receptacle, or can alternatively extend only to a medial portion of the receptacle.

In addition, the present container can further comprise a circumferential band extending around a periphery of the receptacle portion. The circumferential band can include one or more lengths of elastic material for retaining items between the band and the container.

DESCRIPTION

Definitions

As used herein, the following terms and variations thereof have the meanings given below, unless a different meaning is clearly intended by the context in which such term is used.

"Compartment" refers to a space partitioned from another space or spaces by structures such as walls and floors.

"Downward" and "downwardly" mean in the direction of or toward a lower portion of the present container, i.e. toward a support surface on which the container is or can be positioned. "Upward" and "upwardly" mean in the opposite direction, i.e., in the direction of or toward an upper portion of the present container or away from a support surface.

"Enclose" means to surround on at least all vertical sides of the present container or a component thereof, preferably in a continuous manner so as to cover each of the sides. The present container or a component thereof can also be enclosed if all sides of the container or component are surrounded.

"Floor" refers to a generally horizontally extending structure enclosing part of a compartment or a portion thereof, usually located in a lower end or lower portion of the compartment.

"Horizontal" refers to an orientation approximately parallel to (i.e., not substantially extending toward or away from) a support surface on which the present container is supported when in use.

"Inner," "inward," and "inwardly" each refer to a direction or relative position of the present container or of a component of the container which is in a direction toward the horizontal or vertical center of the container or the component.

"Longitudinal" refers to a direction or shape along or parallel to the length of the present container or a component thereof, i.e. along or parallel to the longer portion of the container or component.

"Lower" refers to the relative position of a portion or component of the present container which is closer to or extending toward a support surface on which the present container is or can be positioned.

"Lumen" refers to a central cavity or compartment of a tubular or other hollow structure.

"Outer," "outward" and "outwardly" each refer to a direction or relative position of the present container or of a component of the container which is in a direction away from the horizontal or vertical center of the container or the component.

"Upper" refers to the relative position of a component or portion of the present container which is further from or extending away from a support surface on which the present container is or can be positioned.

"Vertical" refers to an orientation extending toward or away from a support surface on which the present container is supported when in use.

"Wall" refers to a vertically extending structure enclosing part of a compartment of the present container or a portion thereof.

The term "comprise" and variations of the term, such as "comprising" and "comprises," are not intended to exclude other additives, components, integers or steps. The terms "a," "an," and "the" and similar referents used herein are to be construed to cover both the singular and the plural unless their usage in context indicates otherwise.

Dual Lumen Container

The present device can be used to store a variety of personal items, such as tissues, hand sanitizer, or candy, and then to dispose of them in a clean and sanitary way. The present device therefore helps to maintain personal hygiene while also preserving the environment. It comprises a container 1 with divided storage compartments that allows for storage of unused items on one side and retention of trash on the other side.

Figure 2:
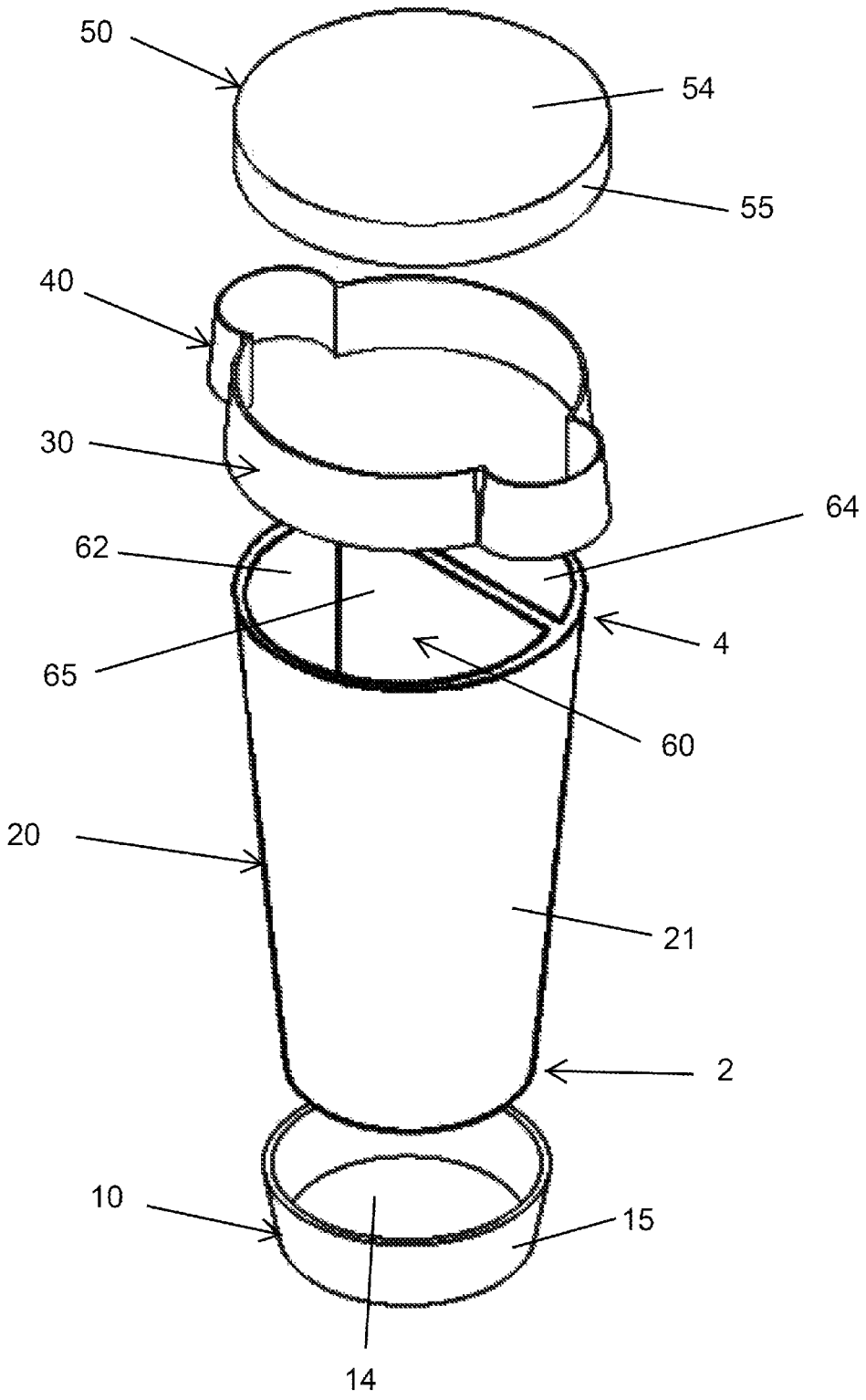
FIG. 2 is an exploded perspective view of the container of FIG. 1.

As can be seen for example in FIGS. 1 and 2, in one embodiment the present container 1 includes a bottom lid 10, a dual lumen receptacle 20, an adjustable band 30, a bottle holder 40 and a top lid 50. The bottom lid 10, the storage receptacle 20, the band 30 and the top lid 50 can be made of any of a variety of suitably rigid materials, such as a polymer plastic material. Preferably, sustainable, recyclable, and/or recycled materials such as recycled plastic or paper products are used to form these components of the present device 1.

The top cover 50 includes an upper surface 54 on the exterior (top) of the cover 50, a lower surface on the interior of the cover 50, and one or more downwardly extending walls, which preferably surround the periphery of the upper end 4 of the receptacle 20 when placed on the receptacle 20 and form a rim 55. The lower cover 10 likewise includes a lower surface on the exterior (bottom) of the lower cover 10, an upper surface 14 on the interior of the lower cover 10, and an upwardly extending rim 15. The upper surface 54 of the top cover 50 is preferably approximately horizontal and parallel to the lower surface of the lower cover 10. The top cover 50 and bottom cover 10 can be reversibly secured to the receptacle 20, so that they can be removed by a user. The covers can be secured by any of a variety of mechanisms known to the art, such as through use of threads on the interior surface of the rims which engage corresponding grooves on the exterior surface 21 of the receptacle 20 in the manner of a screw top. In one embodiment, one or both of the covers can be formed from an elastic material, and can be sized so as to have a circumference slightly smaller than that of the end of the receptacle 20 that it covers, in order to fit securely with an interference fit.

Figure 3:
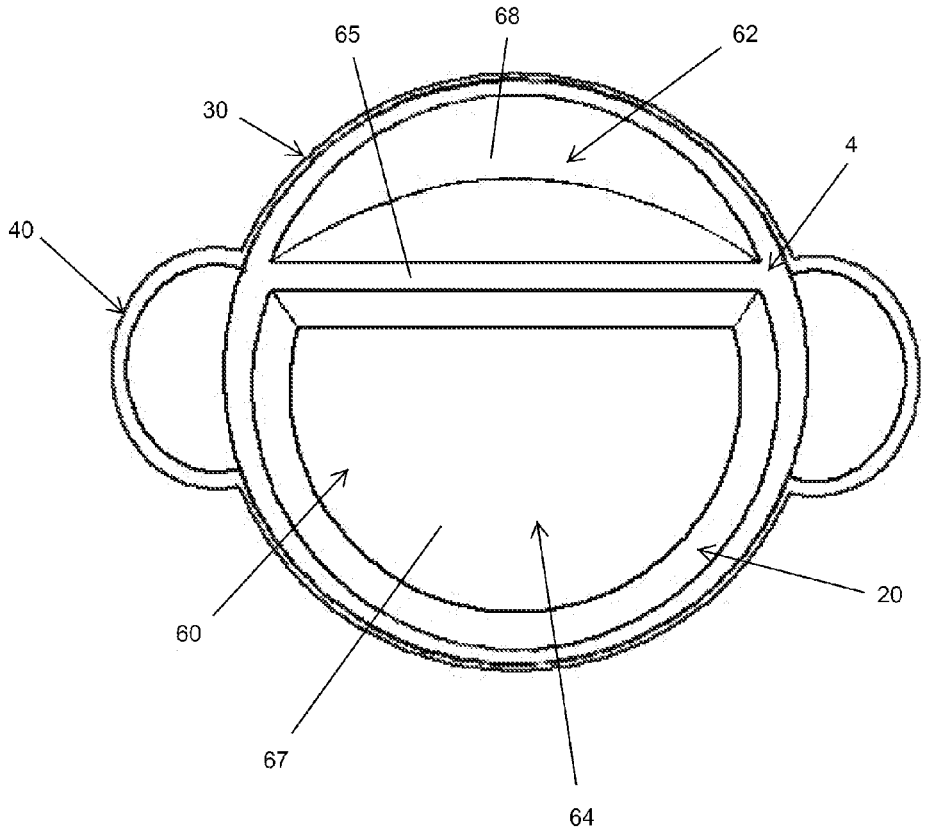
FIG. 3 is a top plan view of the container of FIG. 1, without the top cover.
Figure 4:
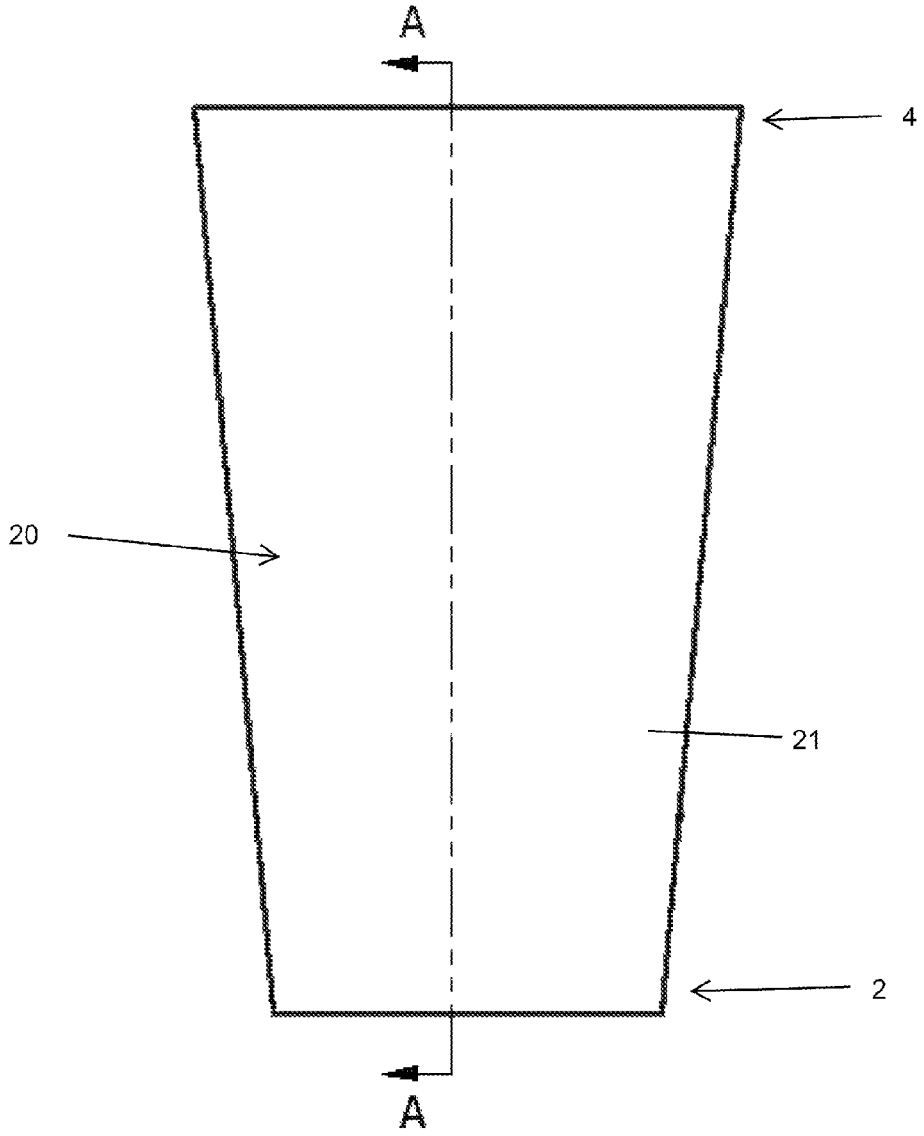
FIG. 4 is a side elevation view of the receptacle portion of the container of FIG. 1.
Figure 5:
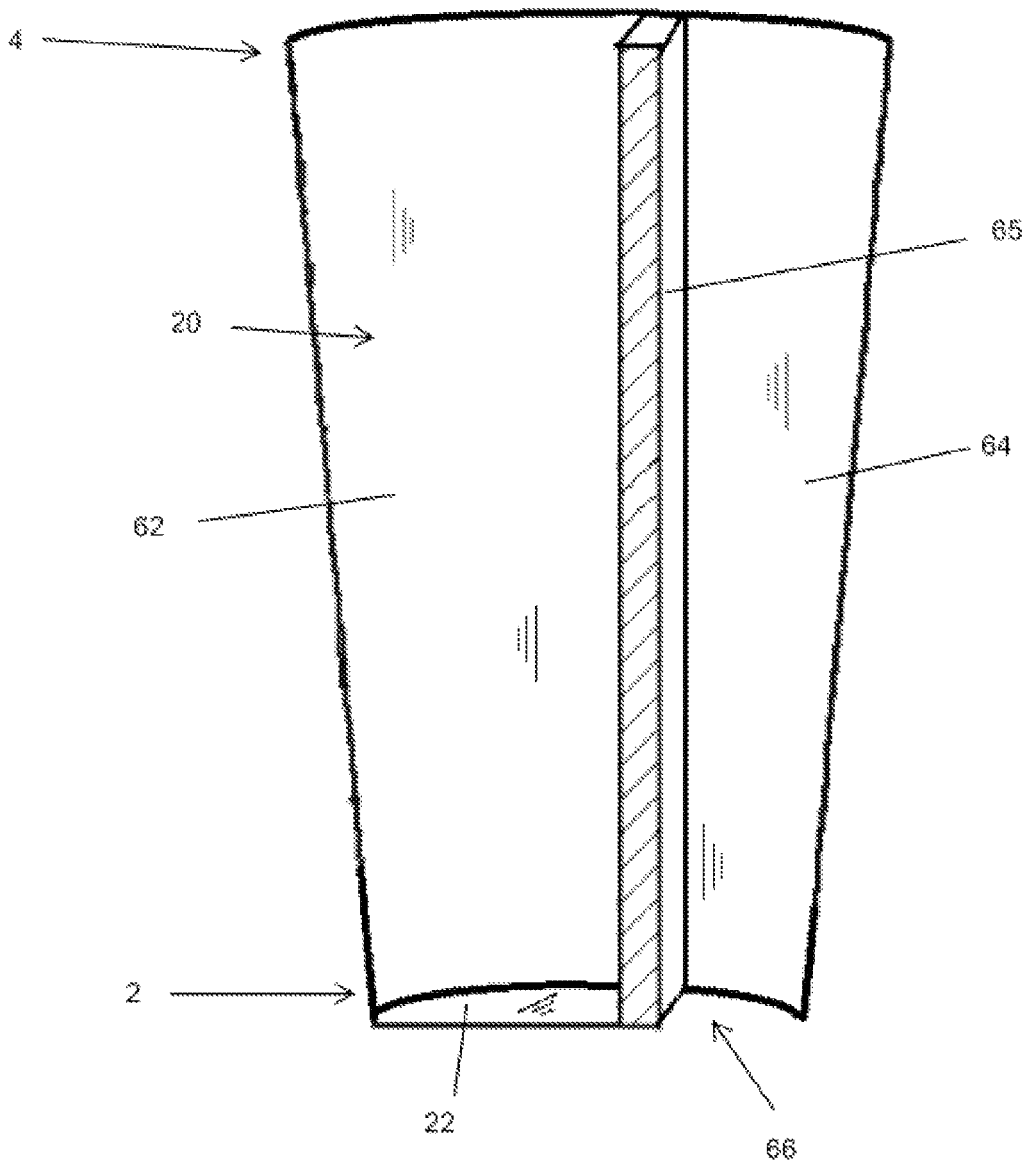
FIG. 5 is a cross-sectional view of the receptacle of FIG. 1 along line A-A.

As best seen in FIGS. 3-5, the receptacle 20 includes an outer surface 21 on the exterior of the receptacle and two chambers or lumens 60 in the interior of this component. The receptacle 20 is preferably frusto-conical or cylindrical in shape. In a preferred embodiment, the two lumens 60 comprise a larger chamber lumen 62 and a smaller chamber lumen 64 separated by a central vertical wall 65 which extends from a lower end of the receptacle to the upper end and physically divides one lumen from the other, i.e. such that materials in one lumen do not mix with contact materials stored in the other lumen. Preferably, the central vertical wall 65 rigid, although a flexible wall is also possible. The central vertical wall 65 is also preferably continuous, for reasons of better hygiene, but in some embodiments a discontinuous wall, such as a wall having holes, perforations, or other apertures is also possible. As described further below, the larger lumen 62, which has a larger volume than the smaller lumen 62, is advantageously used for storing unused items such as food or unused hygienic items, while the smaller lumen 62 is advantageously used as a trash receptacle. Each of the lumens 62, 64 has an upper opening at an upper end 4 of the present container 1, and in a preferred embodiment both of these upper openings are covered when the upper cover 50 is placed on the upper end of the receptacle 20. The upper opening 67 of the larger lumen 62 preferably has a larger area than the upper opening 68 of the smaller lumen 64.

At the lower end 2 of the container 1, one of the lumens (lumen 62 in FIG. 5) includes a floor 69 having lower surface 22, and creates a chamber which is closed at the lower end 2 of the container 1 for storing unused items. The lumen (or compartment) 62 is thereby closed at its lower end so as to retain items either with or without the lower cover 10. Preferably the floor 69 is continuous, so as to prevent contact between items stored in the closed lumen 62 and items stored in "open" lumen 64 having a lower opening 66. The lower opening 66 in the lower end of lumen 64 is for removing items (waste items) from that lumen when the lower cover 10 is removed from the container 1. When the lower cover 10 is secured to the lower end 2 of the container 1, the upper surface 14 of the lower cover 10 functions as a floor of the open lumen 64 to prevent items from falling out of the lumen 64 until the lower cover 10 is removed from the container 1.

When the open lumen 64 is used to retain waste items, and when this lumen becomes filled with such waste items and/or a user simply desires to empty the open lumen 64, the bottom lid 10 of the storage container can be removed to release such waste, which can be emptied into a garbage bin without the user's hands ever coming in contact with the waste. The rim 15 of the lower cover 10 advantageously provides a gripping surface for a user which also serves to help keep the user's hands from contacting waste items. Unused items are also advantageously retained in the closed lumen 62. When the upper cover 50 is secured to the lower end 2 of the container 1, the lower surface of the upper cover 50 functions as an upper closure of the open lumen 64 to prevent items from spilling out of the upper end of the closed lumen 62 until the upper cover 50 is removed from the container 1. One advantage of the present container 1 is that when the top cover 50 is secured to the upper end 4 of the container 1 and the lower cover 10 is removed, waste items can be shaken out of the container 1 without spilling unused items in the closed lumen 62.

In a preferred embodiment, the present container 1 further includes an adjustable loop or circumferential band 30 that can be moved into a variety of positions along the longitudinal extent of the receptacle 20 by vertically sliding the band 30 over the top or bottom of the container 1. Adjustability can, for example, be provided by the use of an elastic material to form the band 30. The band 30 preferably comprises one or two adjustable bottle holders 40 that can hold appropriately sized bottle or other items, such as lotion, hand sanitizer, or baby powder. The bottle holder 40 is made of an elastic material, and preferably comprises a length of the circumferential band. The elasticity of the bottle holder 40 allows it to be stretched to accommodate a bottle or other item. Such items are placed between the exterior surface 21 of the receptacle 20 and the interior surface of the bottle holder 40 (i.e. the surface facing the exterior surface 21 of the receptacle 20), and are held to the exterior surface 21 of the receptacle 20 by a friction or interference fit.

Figure 6:
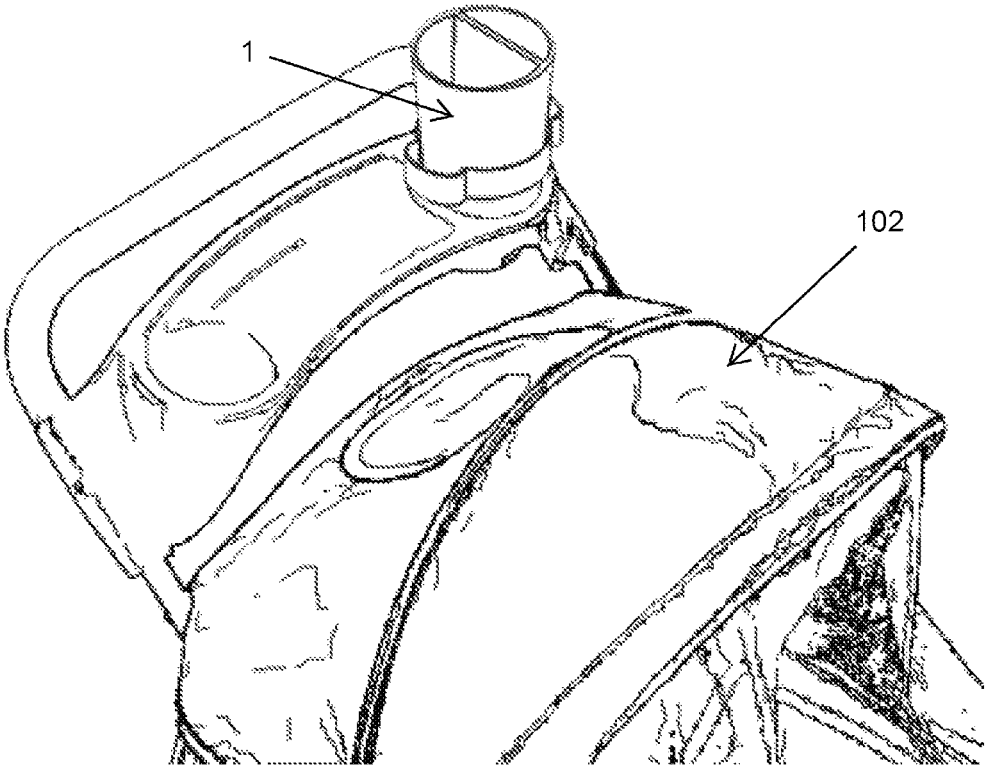
FIG. 6 is a perspective view illustrating the use of an embodiment of the present container with a child's stroller.

The present container 1 is preferably sized so that at least its lower end 2 is able to be retained within a conventional cup holder. For example, as shown in FIG. 6, the current container 1 can be placed in the cup holder of a child's stroller 102. In this use, the container 1 can be advantageously used to store wipes, tissues, pacifiers, or food packets that a parent constantly needs in taking care of a child, as well as to store the dirty remnants of such items, to be emptied out at a later time. The user can either cover the container 1 or leave it open, depending on his or her preference.

Figure 7:
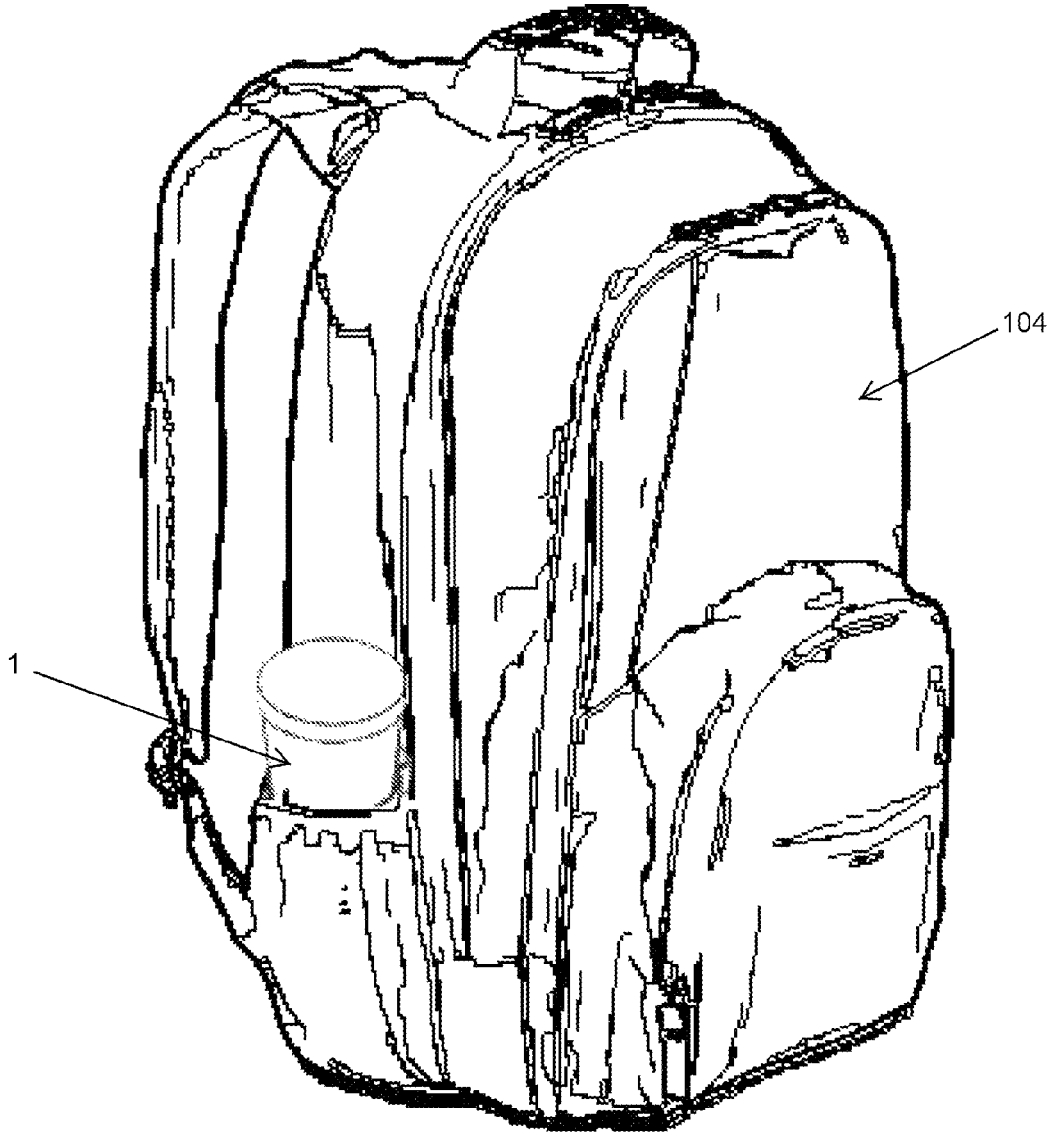
FIG. 7 is a perspective view illustrating the use of the present container with a backpack.
Figure 8:
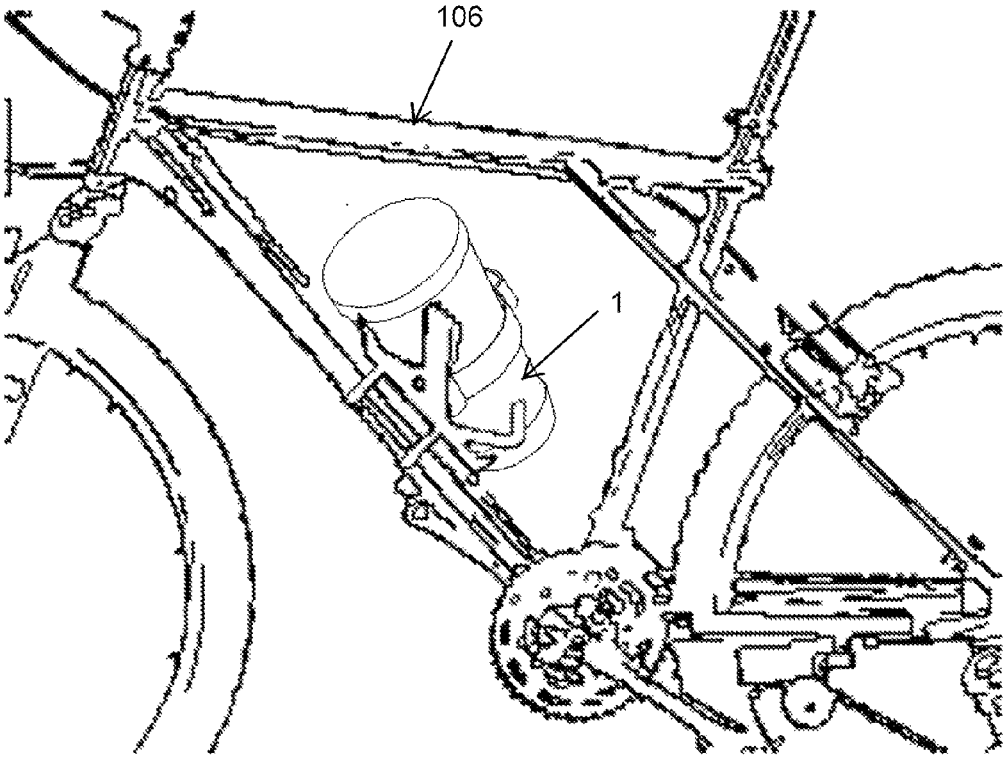
FIG. 8 is a perspective view illustrating the use of the present container with a bicycle.
Figure 9:
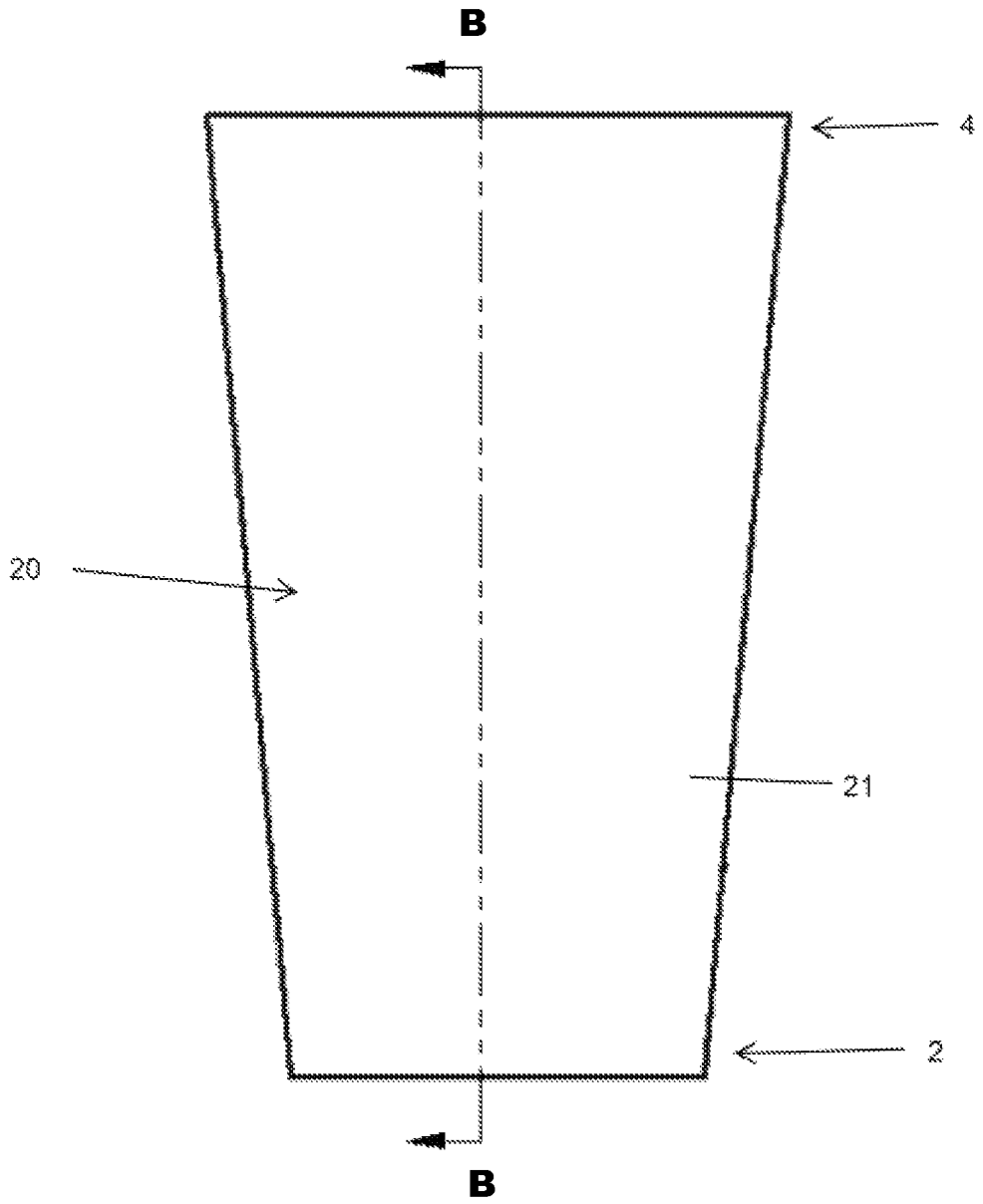
FIG. 9 is a side elevation view of the receptacle portion of another embodiment of the present container.

FIG. 7 shows the present container 1 inside a mesh holder of a backpack 104. Due to the convenient portability of the present invention, a user can place the container 1 in a bag or purse and store tissues, napkins, bandages, clips, makeup, or food packets, for example, on one side. FIG. 8 shows yet another use of the current container 1, namely in a bottle holder of a bicycle 106, in which case the container 1 can be used to store bandages, tissues, athletic aids, or food packets, for example. Any of a variety of personal items can be stored in the unused item storage compartment of the present device in this embodiment, for example food, tissues, personal wipes, or napkins. The waste compartment can then be used to store such items after they have been used or otherwise processed for use, such as used tissues, candy wrappers, and berry pits.

In one embodiment, shown for example in FIG. 5, the present container 1 has the further advantage of comprising a storage compartment, i.e. the closed lumen 62, which has a larger interior volume than the waste compartment, i.e. the open lumen 64. The volume of the closed lumen 62 is bounded on the upper end by the lower surface of the upper cover 50 when placed on the container 1, while the volume of the open lumen 64 is bounded on the upper end by the lower surface of the upper cover 50 and on the lower end by the upper surface 14 of the lower cover 10. Waste was relatively inconvenient to remove from prior containers, due to the need to remove it from the top of the container, so the waste compartment needed to be at least equal in volume to or have a larger volume than the storage compartment, i.e. so that the container would not need to be emptied until the stored items were all used. In this way, the user could wait until the storage compartment was empty of unused items before emptying the waste compartment, such as by overturning it. Otherwise, when loose items such as chips, candy or nuts are stored in such a container, the top opening must be closed in order to prevent such loose items from being dispensed when the waste is removed, and/or to prevent contact between the waste being removed and the stored, unused/uneaten items. By contrast, the waste compartment (open lumen 64) of the present container can be easily emptied without risking loss of unused items in the adjacent compartment and/or contact between such unused items and the waste being dispensed, by simply removing the lower cover 10 and holding the container 1 over a larger waste container, such as a garbage can, without the user ever touching the trash in the container 1. The upwardly extending rim 15 of the lower cover 10 assists in preventing contact with waste by providing a clean surface (i.e., a surface not in contact with waste in the waste compartment) for a user to grasp when opening the lower opening 66.

Figure 10:
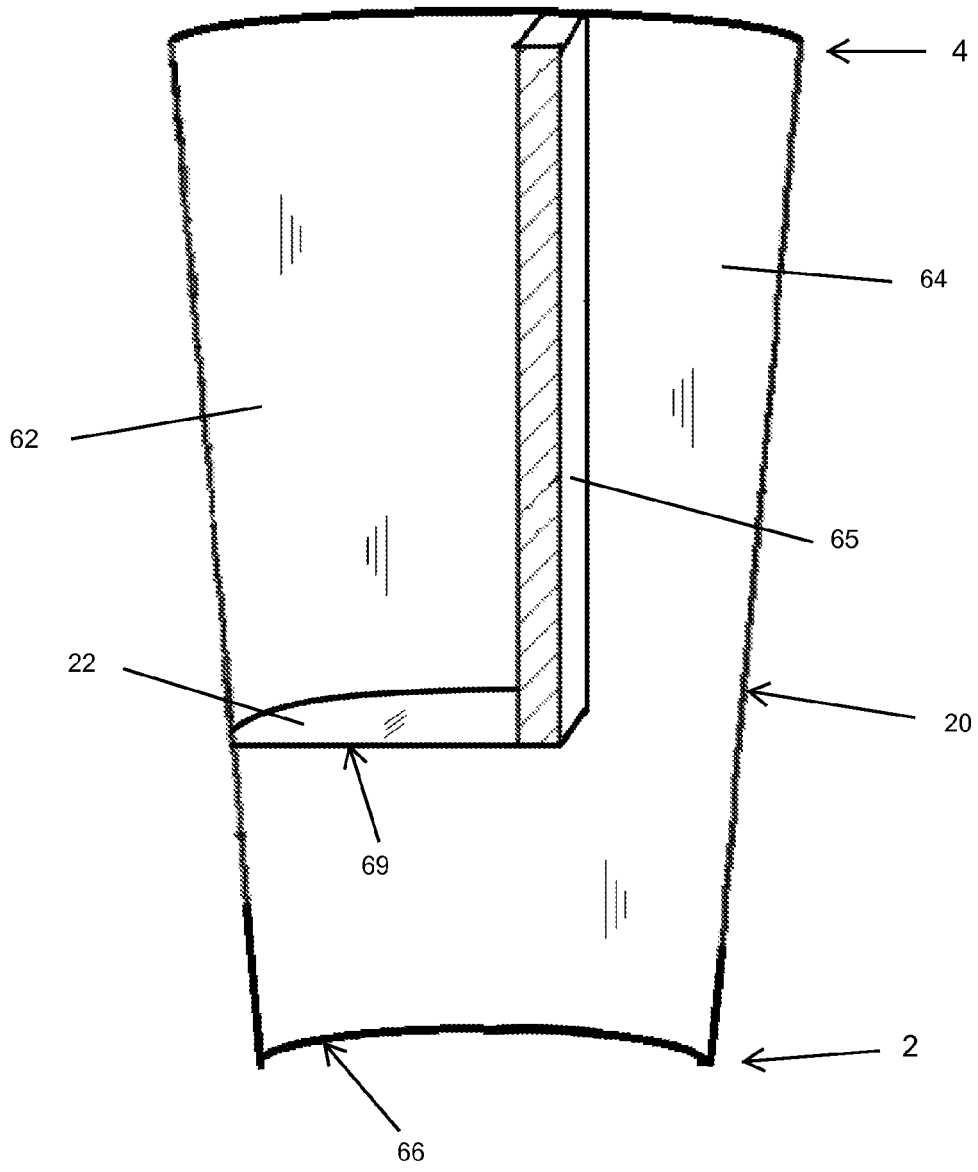
FIG. 10 is a cross-sectional view of the receptacle of FIG. 9 along line B-B.

Alternatively, when unused items can be provided in a more compact volume than after use, as with facial tissues, it can be advantageous to provide a closed lumen 62 having a volume which is smaller than the volume of the open lumen 64. FIG. 10 illustrates one such embodiment. In the embodiment of FIG. 10, the central vertical wall 65 extends from the upper end 4 of the receptacle portion 20 of the container 1 to a medial portion of the receptacle, i.e. between the upper end 4 and lower end 2, and preferably at or adjacent to the central portion of the receptacle 20.

In a preferred embodiment, the upper opening of one of the lumens preferably has a larger area than the upper opening of the other lumen, in order to provide a visual signal to the user regarding which lumen is storing unused items and which lumen is storing used (waste) items. In the embodiment shown in FIGS. 2-5, the upper opening 67 of the closed lumen 62 is larger in area than the upper opening 68 of the open lumen 64, while in the embodiment shown in FIG. 10 the upper opening 67 of the closed lumen 62 is smaller in area than the upper opening 68 of the open lumen 64. This reduces the amount of attention a user must devote when using the present container 1, which can be an advantage in situations such as when the user is operating an automobile. The lower opening 66 of the waste compartment 64 can be either smaller in area than the lower floor 69 of the closed lumen 62, or can be equal or larger in area, in order to facilitate disposal of waste items. In the embodiment of FIG. 10, the lower end 2 of the receptacle 20 is completely open, i.e. the periphery of the lower opening 66 is contiguous with the periphery of the lower end 2 of the receptacle 20.

Although the present invention has been described in considerable detail with reference to certain preferred embodiments, other embodiments are possible. The components and steps disclosed herein, for example, are not intended to be limiting, nor are they intended to indicate that each component or step is necessarily essential to the present invention, but instead are exemplary only. Therefore, the scope of the appended claims should not be limited to the description of preferred embodiments contained in this disclosure. All references cited herein are incorporated by reference in their entirety.

What is claimed is:

1. A dual lumen portable storage and waste container, comprising:

(a) a receptacle portion having an open upper end, a lower end, and one or more vertical walls extending between the upper end and the lower end, comprising:

(i) a first lumen having an open upper end, an open lower end, and one or more outer vertical walls extending between the upper end and the lower end;

(ii) a second lumen having an open upper end, a lower end, and one or more outer vertical walls extending between the upper end and the lower end; and (iii) a central vertical wall separating the first lumen from the second lumen; and (iv) a floor in the lower end of the second lumen extending between the central vertical wall and the one or more outer vertical walls of the second lumen, wherein the floor, the central vertical wall, and the one or more outer vertical walls of the second lumen form a compartment having an open upper end and a closed lower end, wherein the floor is in the lower end of the receptacle and the central vertical wall extends from the upper end of the receptacle to the lower end;

(b) an upper cover having a horizontal surface covering the open upper end of the receptacle portion and one or more downwardly extending vertical walls, wherein the horizontal surface has an upper face and a lower face, the vertical walls extending downwardly from the upper end of the receptacle portion; and (c) a lower cover having a horizontal surface covering the open lower end of the first lumen and the closed lower end of the second lumen and one or more upwardly extending vertical walls, wherein the horizontal surface has an upper face and a lower face, the vertical walls extending upwardly from the lower end of the receptacle portion, wherein the upper cover is reversibly securable to the upper end of the receptacle portion so as to cover the upper end of the receptacle portion, and wherein the lower cover is reversibly securable to the lower end of the receptacle portion so as to cover the lower end of the receptacle portion.

2. The container of claim 1, wherein the first lumen has a first volume and the second lumen has a second volume, and wherein the second volume of the second lumen is greater than the first volume of the first lumen.

3. The container of claim 1, wherein the lower cover is formed from an elastic material and is retained on the lower end of the receptacle portion by an interference fit.

4. The container of claim 1, wherein the upper cover is formed from an elastic material and is retained on the upper end of the receptacle portion by an interference fit.

5. The container of claim 1, wherein the upwardly extending vertical walls of the lower cover surround the periphery of the lower end of the receptacle portion and form a rim.

6. The container of claim 1, wherein the downwardly extending vertical walls of the upper cover surround the periphery of the upper end of the receptacle portion and form a rim.

7. The container of claim 1, wherein the open upper end of the first lumen is larger in area than the open upper end of the second lumen.

8. The container of claim 1, wherein the open upper end of the second lumen is larger in area than the open upper end of the first lumen.

9. The container of claim 1, wherein the diameter of the upper end of the receptacle portion is greater than the diameter of the lower end of the receptacle portion, and wherein the receptacle portion is frusto-conical in shape.

10. The container of claim 1, wherein the central vertical wall extends from the upper end of the receptacle portion to the lower end of the receptacle portion.

11. The container of claim 1, wherein the central vertical wall extends from the upper end of the receptacle portion to a medial portion of the receptacle portion.

12. The container of claim 1, further comprising a circumferential band extending around a periphery of the receptacle portion.

13. The container of claim 12, wherein the circumferential band comprises a length of elastic material for retaining items.

14. A dual lumen portable storage and waste container, comprising:

(a) a receptacle portion having an open upper end, a lower end, and one or more vertical walls extending between the upper end and the lower end, comprising:

(i) a first lumen having an open upper end, an open lower end, and one or more outer vertical walls extending between the upper end and the lower end;

(ii) a second lumen having an open upper end, a lower end, and one or more outer vertical walls extending between the upper end and the lower end; and (iii) a central vertical wall separating the first lumen from the second lumen; and (iv) a floor in the lower end of the second lumen extending between the central vertical wall and the one or more outer vertical walls of the second lumen, wherein the floor, the central vertical wall, and the one or more outer vertical walls of the second lumen form a compartment having an open upper end and a closed lower end, wherein the floor is in the lower end of the receptacle and the central vertical wall extends from the upper end of the receptacle to the lower end;

(b) an upper cover having a horizontal surface covering the open upper end of the receptacle portion and one or more downwardly extending vertical walls, wherein the horizontal surface has an upper face and a lower face, the vertical walls extending downwardly from the upper end of the receptacle portion; and (c) a lower cover having a horizontal surface covering the open lower end of the first lumen and the closed lower end of the second lumen and one or more upwardly extending vertical walls, wherein the horizontal surface has an upper face and a lower face, the vertical walls extending upwardly from the lower end of the receptacle portion, wherein the upper cover is reversibly securable to the upper end of the receptacle portion so as to cover the upper end of the receptacle portion, and wherein the lower cover is reversibly securable to the lower end of the receptacle portion so as to cover the lower end of the receptacle portion, wherein the upwardly extending vertical walls of the lower cover surround the periphery of the lower end of the receptacle portion and form a rim, wherein the open upper end of the second lumen is larger in area than the open upper end of the first lumen, and wherein the first lumen has a first volume and the second lumen has a second volume, and wherein the second volume of the second lumen is greater than the first volume of the first lumen.

* * * * *